US010024015B2

(12) United States Patent
De Waard et al.

(10) Patent No.: US 10,024,015 B2
(45) Date of Patent: Jul. 17, 2018

(54) SUPPORT DEVICE CONFIGURED TO BE POSITIONED ON A LIFTING VESSEL IN ORDER TO LIFT A TOPSIDE FROM ITS SUPPORT STRUCTURE

(71) Applicant: Heerema Marine Contractors Nederland SE, Leiden (NL)

(72) Inventors: Onno Ludolf De Waard, Leiden (NL); Ernst Frederik Jacobus Van Bruggen, Leiden (NL)

(73) Assignee: HEEREMA MARINE CONTRACTORS NEDERLAND SE, Leiden (NL)

( * ) Notice: Subject to any disclaimer, the term of this patent is extended or adjusted under 35 U.S.C. 154(b) by 0 days.

(21) Appl. No.: 15/539,057

(22) PCT Filed: Dec. 22, 2015

(86) PCT No.: PCT/NL2015/050898
§ 371 (c)(1),
(2) Date: Jun. 22, 2017

(87) PCT Pub. No.: WO2016/105192
PCT Pub. Date: Jun. 30, 2016

(65) Prior Publication Data

US 2017/0356153 A1 Dec. 14, 2017

(30) Foreign Application Priority Data

Dec. 23, 2014 (NL) ..... 2014042

(51) Int. Cl.
*E02B 17/08* (2006.01)
*E02B 17/02* (2006.01)
(Continued)

(52) U.S. Cl.
CPC ..... *E02B 17/0809* (2013.01); *B63B 9/06* (2013.01); *B63B 35/003* (2013.01);
(Continued)

(58) Field of Classification Search
CPC combination set(s) only.
See application file for complete search history.

(56) References Cited

U.S. PATENT DOCUMENTS 4,408,930 A * 10/1983 Ninet ..... B63B 35/003 248/632
4,607,982 A * 8/1986 Brasted ..... E02B 17/024 405/195.1
(Continued)

FOREIGN PATENT DOCUMENTS

WO 0154968 A1 8/2001

OTHER PUBLICATIONS

International Search Report and Written Opinion dated May 30, 2017 for Application No. PCT/NL2015/050898.
(Continued)

*Primary Examiner* — Kyle Armstrong
(74) *Attorney, Agent, or Firm* — Patterson + Sheridan, L.L.P.

(57) ABSTRACT

A support device configured to be positioned on a lifting vessel in order to support a topside of an offshore platform, the support device comprising: a main cylindrical casing having an upper opening, the main casing defining a main vertical axis, the main casing further defining an upper support rim, a reservoir located inside the main casing for holding a granular material or a fluid, the reservoir having a discharge opening for emptying the reservoir, a spring support slideably arranged within the main casing, the spring support resting on the granular material or the fluid and being movable from an upper position to a lower
(Continued)

position in dependence on a filing degree of the reservoir, a spring device positioned on the spring support, a receptor support positioned on the spring device, the receptor support defining an upper surface, and a receptor device.

20 Claims, 17 Drawing Sheets

(51) Int. Cl.
*B63B 35/00* (2006.01)
*B63B 9/06* (2006.01)
*E02B 17/00* (2006.01)

(52) U.S. Cl.
CPC . *B63B 2009/067* (2013.01); *E02B 2017/0047* (2013.01); *E02B 2017/0052* (2013.01)

(56) References Cited

U.S. PATENT DOCUMENTS 4,744,697 A 5/1988 Coppens
5,219,451 A * 6/1993 Datta ..... E02B 17/024 405/203
5,522,680 A * 6/1996 Hoss ..... E02B 17/00 405/195.1
6,648,553 B2 * 11/2003 Rolfsnes ..... B63B 35/003 114/125
6,981,823 B2 * 1/2006 Roraas ..... E02B 17/00 405/195.1
8,753,039 B2 * 6/2014 Ytournel ..... B63B 35/003 114/26
9,080,633 B2 * 7/2015 Ab Malek ..... E02B 17/024
2002/0108553 A1 * 8/2002 Rolfsnes ..... B63B 35/003 114/265
2004/0218983 A1 * 11/2004 Roraas ..... E02B 17/00 405/204
2012/0000407 A1 * 1/2012 Ytournel ..... B63B 35/003 114/26

OTHER PUBLICATIONS

Search Report and Written Opinion dated Aug. 30, 2015 for Netherland Application No. NL2014042.
United States Statutory Invention Registration No. H1,815 dated Nov. 2, 1999, Campbell et al.

* cited by examiner

SUPPORT DEVICE CONFIGURED TO BE POSITIONED ON A LIFTING VESSEL IN ORDER TO LIFT A TOPSIDE FROM ITS SUPPORT STRUCTURE

FIELD OF THE INVENTION

The present invention relates to the lifting of a topside from its support structure in a marine environment. The combination of the topside and the support structure is herein referred to as an offshore platform. Such offshore platforms are well known and are mainly used to produce hydrocarbons at sea. For instance in the North Sea, many offshore platforms have been installed. In other areas in the world, offshore platforms are also used.

BACKGROUND OF THE INVENTION

Generally, the topsides are supported by a support structure which is partially submerged. These support structures may rest on the seabed. The support structure extends to a certain height above the water level to support the topside at a height where it is safe from the impact of waves. So called "jackets" are a commonly used type of support structure. A jacket is basically a large steel structure comprising many beams, including legs and cross-beams which interconnect the legs. Other kinds of support structures are also widely used, such as structures made from concrete columns.

The offshore platforms typically have a life expectancy of about 30 years, but shorter and longer life spans are also known. At the end of their economic life span the offshore platform generally need to be decommissioned, which includes a removal of both the topside and the support structure. The removal operation may be carried out in separate operations. Generally the topside is removed first. Subsequently, the support structure is removed.

One method of removing a topside is to remove it in small pieces. This is a very time consuming process and therefore disadvantageous.

Another known method of lifting and removing a topside from its support structure is to use a heavy lift vessel comprising cranes. With the cranes, the topside is hoisted from the support structure and subsequently placed on the deck of the heavy lift vessel, a barge or other kind of transport vessel. This method works but has some disadvantages.

One disadvantage is that a very heavy lift vessel (or heavy crane vessel) with large capacity cranes is required. These may not always be available. Moreover, very large topsides may be too heavy for this method. Another disadvantage is that structural reinforcements or (re-)installation of removal lift points of the topside may be required to allow the hoisting process.

Another known method is to remove the topside in relatively large modules which are lifted by a heavy crane vessel. This method works but is also time consuming and requires a substantial amount of offshore work. The topside may not always be suitable to be divided in modules.

Various other kinds of specialized lifting vessels have been conceived, such as a so-called shear-leg crane barge, the "Pieter Schelte" by Allseas, the "Twin Marine Lifter", the "Versatruss", the "MPU Heavy Lifter", and the "GM lift concept" by Prosafe. Some of these vessels have been built, others still remain in the design stage or have been cancelled during the design stage. These vessels have a common disadvantage in that the lifting vessel is quite complex and therefore quite expensive to build and operate. Some of these vessels have an additional disadvantage that the lifting capacity is limited.

Another known method is the so-called reversed float-over method. This method is a reversal of the float-over installation method. A specialized lift vessel such as a purposively built barge is positioned at least partially underneath the topside. The lift vessel comprises ballast tanks. With the lift vessel, the topside is lifted from the support structure by deballasting the ballast tanks.

This method also works, but has a disadvantage in that large horizontal loads are introduced into the support structure. This can be explained as follows. It takes a considerable period of time to transfer the total load of the topside with the deballasting process from the support structure to the lifting vessel. This stage of the operation may last several hours i.e. between 1 and 10 hours. During this time period, the combination of barge, topside and support structure is subject to vertical and horizontal loads as a result of wind, waves and current. These loads will be transferred from the barge onto the support structure via the topside. The vertical load generally does not pose a problem, but the support structure is generally not designed to take the horizontal loads. This applies in particular to dynamic loads. A risk of damage or even failure of the support structure may occur. Obviously, this is undesirable.

OBJECT OF THE INVENTION

It is an object of the present invention to provide an alternative device and method of lifting a topside from its support structure.

It is another object of the present invention to provide a relatively simple and cost-efficient device and method of lifting a topside from its support structure.

It is another object of the present invention to provide a device for lifting a topside from its support structure, wherein the device has a large lifting capacity.

It is another object of the present invention to provide an improved reversed float-over method in which less horizontal forces are transferred from the lifting vessel to the topside and the support structure, in particular during the stage in which the vertical load of the topside is transferred from the support structure to the lifting vessel.

It is another object of the present invention to provide a support device for lifting a topside from its support structure in which oscillations of topside relative to the lift vessel at the moment of lift-off are avoided.

It is another object of the present invention to provide an improved method of transport of such a topside.

It is yet another object of the present invention to provide a support device configured to be positioned on a lifting vessel in order to support a topside which is to be lifted by the lifting vessel, wherein the support device is relatively low.

It is another object of the invention to provide a support device for lifting a topside from its support structure which allows sea fastening of the topside to the lifting vessel.

THE INVENTION

In order to achieve at least one object, the invention provides a support device configured to be positioned on a lifting vessel in order to support a topside of an offshore platform which is to be lifted and transported by the lifting vessel, the support device comprising:

a main cylindrical casing having an upper opening, the main casing defining a main vertical axis, the main casing further defining an upper support rim, a reservoir located inside the main casing for holding a granular material or a fluid, the reservoir having a discharge opening for emptying the reservoir, a spring support slideably arranged within the main casing, the spring support resting on the granular material or the fluid and being movable from an upper position to a lower position in dependence on a filing degree of the reservoir, a spring device positioned on the spring support, the spring device being compressible in a vertical direction between an extended state and a compressed state, a receptor support positioned on the spring device, the receptor support defining an upper surface, a receptor device having a lower surface which engages the upper surface of the receptor support, wherein the lower surface and upper surface are constructed to slide relative to one another, wherein a horizontal clearance is defined around the receptor device between the receptor device and the main casing, wherein the receptor support and the horizontal clearance create a horizontal freedom of movement of the receptor device relative to the main casing, wherein the receptor device is configured for receiving a mating connector of a connecting device which is connected to a topside which is to be lifted.

An advantage of the present invention is that the horizontal stiffness of the connection between the lifting vessel and the offshore platform is substantially reduced during the load transfer stage and the lift-off stage of the operation. This substantially reduces the risk that damage or failure of the support structure occurs, in particular when the support structure is relatively weak.

The invention provides a cost-efficient support device, with which a lifting operation can be carried out in a reliable manner.

The static loads may be taken for a large part by mooring lines which moor the lifting vessel to the seabed. The dynamic loads on the lifting vessel are generally transferred to the support structure. The invention may therefore in particular provide the benefit of reducing dynamic horizontal loads on the support structure, and changing static loads such as a changing current, changing wind loads, $1^{st}$ and $2^{nd}$ order wave drift forces.

In an embodiment, the support device creates a rigid vertical support at the moment of lift-off. In this way oscillations of the topside relative to the lift vessel at the moment of lift-off can be avoided or reduced.

In an embodiment, the support device is configured to make a transition from:

an engagement state in which the spring device is uncompressed and the reservoir is filled, into a a load transfer state in which the spring device is in the compressed state and in which a steel on steel support is provided parallel to the spring device, wherein the steel on steel support bears any increase in a vertical force exerted by the connecting device on the support device, and in which the reservoir is filled, and wherein a horizontal freedom of movement exists between the receptor device which accommodates the mating connecting device and the main casing, and from the load transfer state into a transport state in which the reservoir is emptied and the male connecting device directly rests on the main casing of the support device and is connected thereto via a fixed connection.

The spring support may comprise an upward facing contact surface, wherein the receptor support comprises an associated downward facing contact surface, wherein said contact surfaces are configured to engage one another at a predetermined compression of the spring device, wherein the spring device is configured to make a compression stroke between an uncompressed state and a compressed state in which the contact surfaces engage one another, and wherein any subsequent increase in the lifting force is transferred from the receptor support onto the particles in the reservoir via the engaging contact surfaces and not via the spring device, wherein the engaging contact surfaces prevent any further compression of the spring device.

In an embodiment, the receptor device has an upper position in the engagement state, an intermediate position in the load-transfer state and a lower position in the transport state. The receptor devices moves from the upper position to the middle position and from the middle position to the lower position.

The receptor device may be a female receptor device and wherein the mating connector is a male connector. The mechanical inversion is also possible, i.e. a male receptor device and a female mating connector.

In an embodiment, the receptor device has a freedom of movement in two independent horizontal directions relative to the main casing.

The horizontal clearance between the receptor device and the main casing may be annular and resilient members may be provided in the clearance for creating a counterforce when horizontal displacements of the receptor device relative to the main casing occur, and a width of the clearance may in particular be at least 100 mm.

A vertical spring stiffness of the spring device may lie between 10.000 and 30.000 N/mm and a horizontal spring stiffness of the resilient members may lie between 10.000 and 40.000 N/mm.

The spring device may comprise resilient elements, in particular rubber elements.

In an embodiment, the main casing, the reservoir, the spring support, the spring device, the receptor support and the receptor device have a circular form when seen in top view and are coaxially arranged. This results in a compact and practical device.

In an embodiment, the upper support rim of the main casing comprises a tapered part for guiding a mating tapered part of a second contact surface of the male connecting device. This embodiment has an advantage in that the male connecting device is guided into the correct position in a simple manner. In an embodiment, the tapered parts obviate a need for a separate welding operation and provide a fixed connection between the lifting vessel and the topside.

A total height of the support device may be less than 4 meter, in particular less than 3 meter, more in particular about 2 meter. The support unit may be as low as 1 meter, i.e. have a range of 1-4 meter. With the devices of the prior art, a substantial number of topsides cannot be removed because the required height is not available. The known devices are too high, because they need to have a small diameter in order to be positioned in the leg of the support structure. The relatively small height allows the support device of the invention to be used in circumstances in which devices according to the prior art cannot be used, with the result that a different kind of removal operation is necessary.

The reduced height of the support device has a further advantageous effect of reducing moments which the topside exerts on the vessel during the transport. The smaller height may also reduce the chance of uplift during transport.

The present invention further relates to a lifting vessel comprising multiple support units according to any of the preceding claims.

The lifting vessel may comprise a hull and two lifting arms which project from the hull and are suspended over the water surface, wherein the multiple support devices are positioned on the lifting arms. The lifting arms may be supported by supports at a horizontal level which lies at a distance above the deck of the lifting vessel.

The lifting vessel may also be a more traditional float-over vessel, wherein the support devices are positioned on deck, and wherein the vessel is configured for carrying out a float-over operation in which a hull of the vessel is positioned underneath the topside.

In an embodiment, the lifting vessel comprises:

upper ballast tanks positioned above the water line, in particular on deck, wherein the upper ballast tanks comprise discharge valves and are constructed to be quickly emptied under the force of gravity for quickly increasing a lifting capability of the lifting vessel lower ballast tanks within the hull of the lifting vessel and positioned at least partially below the water line, and a pumping system with which the lower ballast tanks can be emptied relatively slowly.

The lifting vessel may be elongate and comprise two lifting arms at a bow or stern of the vessel, the lifting arms projecting in a general longitudinal direction away from the hull, wherein the upper ballast tanks comprise at least two groups of upper ballast tanks:

a first group positioned near the lifting arms, and a second group positioned on the rear half of the lifting vessel.

The two groups may be independently emptied and filled.

The present invention further relates to a connecting device constructed to mate with the support device according to any of the preceding claims, the connecting device comprising:

an upper base plate, a mating connector, configured to mate with the receptor device of the support device according to the invention, at least one first contact surface which faces downward, the at least one first contact surface being configured for engaging an upper receptor contact surface of the support device according to the invention, and at least one second contact surface which faces downward and is provided circumferentially around the at least one second contact surface, the at least one second contact surface being configured for engaging a upper support rim of the support device according to the invention, and at least one connecting area, in particular a welding area, constructed to be connected to the main casing of the support device according to any of the preceding claims.

The at least one first contact surface may be provided circumferentially around the mating connector, and wherein the at least one second contact surface is provided circumferentially around the at least one first contact surface.

In an embodiment the mating connector is a male connector, in particular having a cone shape, which projects downwardly from the upper base plate.

The present invention further relates to a combination of a support device according to the invention and a connecting device according to the invention.

The receptor device may define an upward facing contact surface, and wherein the connecting device defines a downwardly facing contact surface for engaging the upward facing contact surface.

In an embodiment, in the engagement state of the support device a vertical gap is present between the upper support rim of the support device and the at least one second contact surface of the connecting device, and wherein in the load transfer state of the support device said vertical gap has decreased but still exists, and wherein in the transport state said gap is closed.

The present invention further relates to a method of lifting a topside of an offshore platform from its support structure with a lifting vessel, the method comprising:

providing the lifting vessel and providing multiple support devices according to the invention on the support vessel, connecting multiple connecting devices according to the invention comprising a mating connector, at suitable locations to the topside which is to be lifted, positioning the lifting vessel relative to the topside, wherein the respective support devices are positioned vertically underneath the associated mating connectors, de-ballasting the lifting vessel in a first lifting step and engaging the support devices with the mating connectors, wherein a vertical lifting force exerted by the support devices on the mating connector is increased relatively quickly to a predetermined force in order to prevent disengagement of the support devices from the associated mating connectors, wherein the spring device is compressed in order to prevent disengagement of the support devices from the associated mating connectors, de-ballasting the lifting vessel in a second lifting step, wherein the weight of the topside is transferred to the lifting vessel, wherein a horizontal freedom of movement is maintained between the topside and the lifting vessel during the weight transfer, reducing the volume of the reservoir so that the upper base plate contacts the upper support rim thereby supporting the topside.

The method has the same advantages as the support device.

In an embodiment, the method comprises lifting the topside from its support structure by further de-ballasting the lifting vessel in a third lifting step, wherein the third lifting step takes place relatively quickly in order to create a clearance between the topside and the remaining support structure to prevent impact of the topside with the remaining support structure.

In an embodiment of the method:

in the first lifting step the upper ballast tanks are at least partially emptied in order to ensure a quick minimum lifting force of the support devices and to prevent impact of the support devices against the mating connectors under the influence of wind, waves and current, in the second lifting step the lower ballast tanks are emptied at a relatively slow rate, thereby gradually increasing the lifting force and transferring the weight of the topside to the lifting vessel, in the third lifting step the upper ballast tanks are at least partially emptied in order to quickly lift the topside from the support structure and to create a predetermined clearance between the topside and the support structure.

In an embodiment of the method during the first lifting step the spring device is compressed and the contact surfaces of the spring support and the receptor support engage one another, in particular resulting in a steel on steel support, wherein the vertical freedom of movement between the support device and the mating connecting device is removed.

In an embodiment of the method, during the first lifting step the vertical gap between the upper support rim and the at least one second contact surface is reduced but is not entirely closed.

In an embodiment of the method, after the third lifting step the reservoir is emptied via the discharge opening, thereby lowering the spring support, the spring device, the receptor support and the receptor device, wherein the vertical gap between the upper support rim and the at least one second contact surface is closed, and wherein the vertical load is no longer transferred via the receptor device and the mating connector, but via the second contact surface and the upper support rim.

In an embodiment of the method, by the emptying of the reservoir the receptor device is lowered from a middle position to a lower position and a second vertical gap is created between the upper receptor surface of the receptor device and the at least one first contact surface of the male connecting device.

In an embodiment of the method, after the emptying of the reservoir, the male connectors are welded to the main casing for taking away the horizontal freedom of movement of the connecting device and ensuring a sea fastened connection between the lifting vessel and the topside.

In an embodiment of the method, during the second lifting step the upper ballast tanks are refilled in order to be ready for the third lifting step.

The first lifting step may take between 30 seconds and 5 minutes. The second lifting step may take between 1 and 10 hours. The third lifting step may take between 30 seconds and 5 minutes.

In an embodiment of the method, during the third lifting step a vertical clearance of at least 1 meter is created between the lifted topside and the support structure in order to prevent impact of the topside with the remaining support structure.

In an embodiment of the method, during the positioning of the lifting vessel the lifting arms are inserted between the legs of the support structure.

In an embodiment of the method, prior to the lifting operation, a part of the support structure is removed to provide room for the lifting arms of the lifting vessel.

These and other aspects of the invention will be more readily appreciated as the same becomes better understood by reference to the following detailed description and considered in connection with the accompanying drawings in which like reference symbols designate like parts.

DETAILED DESCRIPTION OF THE FIGURES

Figure 1:
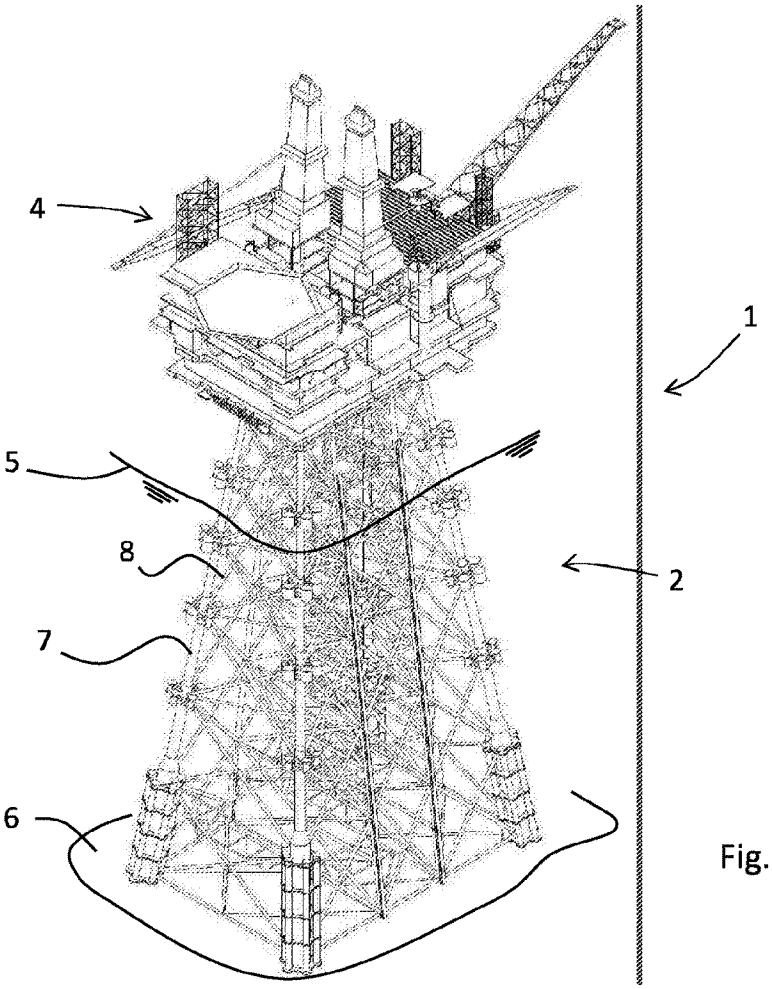
FIG. 1 shows an offshore platform.

Turning to FIG. 1, an offshore platform 1 has a support structure 2 and a topside 4. The water level is indicated with 5. The support structure rests on the seabed 6 and comprises legs 7 and cross beams 8 (or cross bracings). Other types of support structures are known, such as concrete columns, Spars and other support structures.

The topside 4 can have functional multiple parts such as a drilling unit, a hydrocarbon processing plant, living quarters, a crane, etc.

Figure 2A:
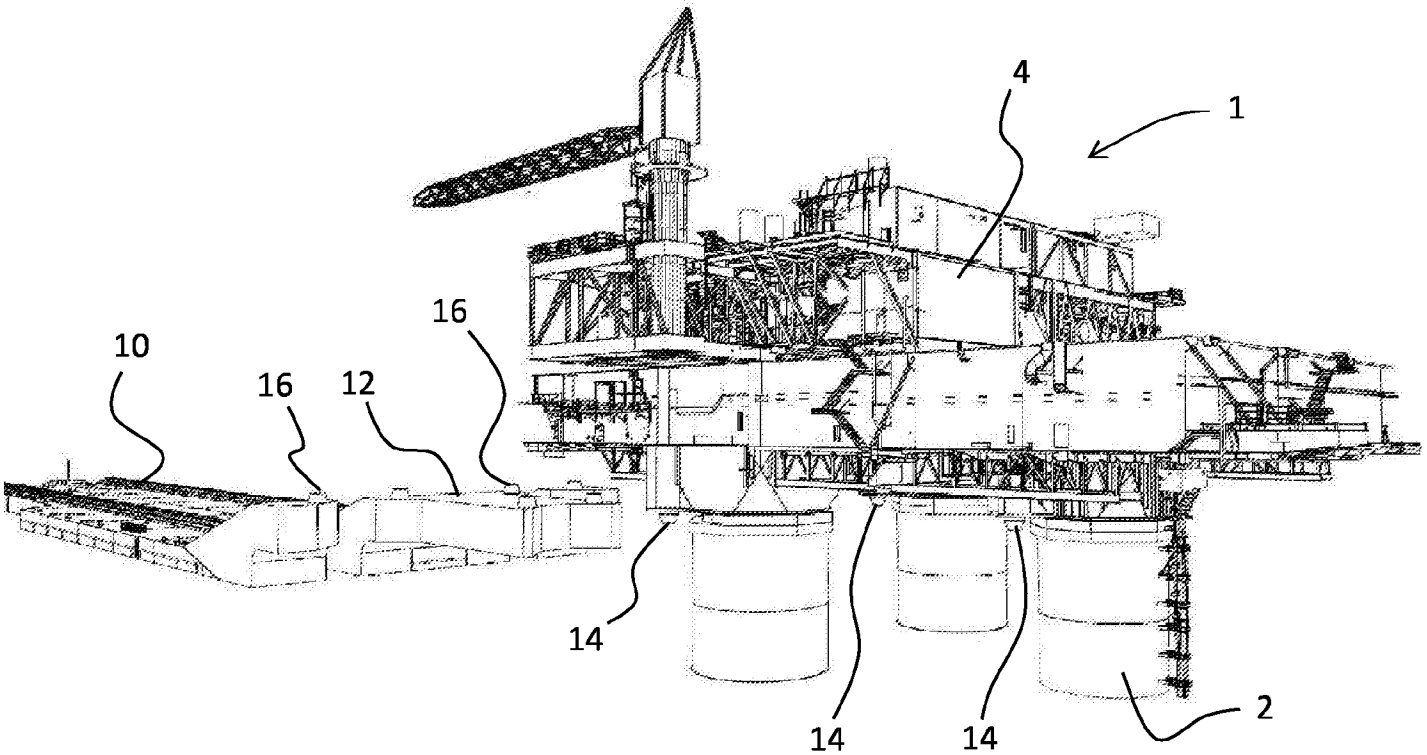
FIGS. 2A-2F show a reversed float over method according to the prior art.
Figure 2B:
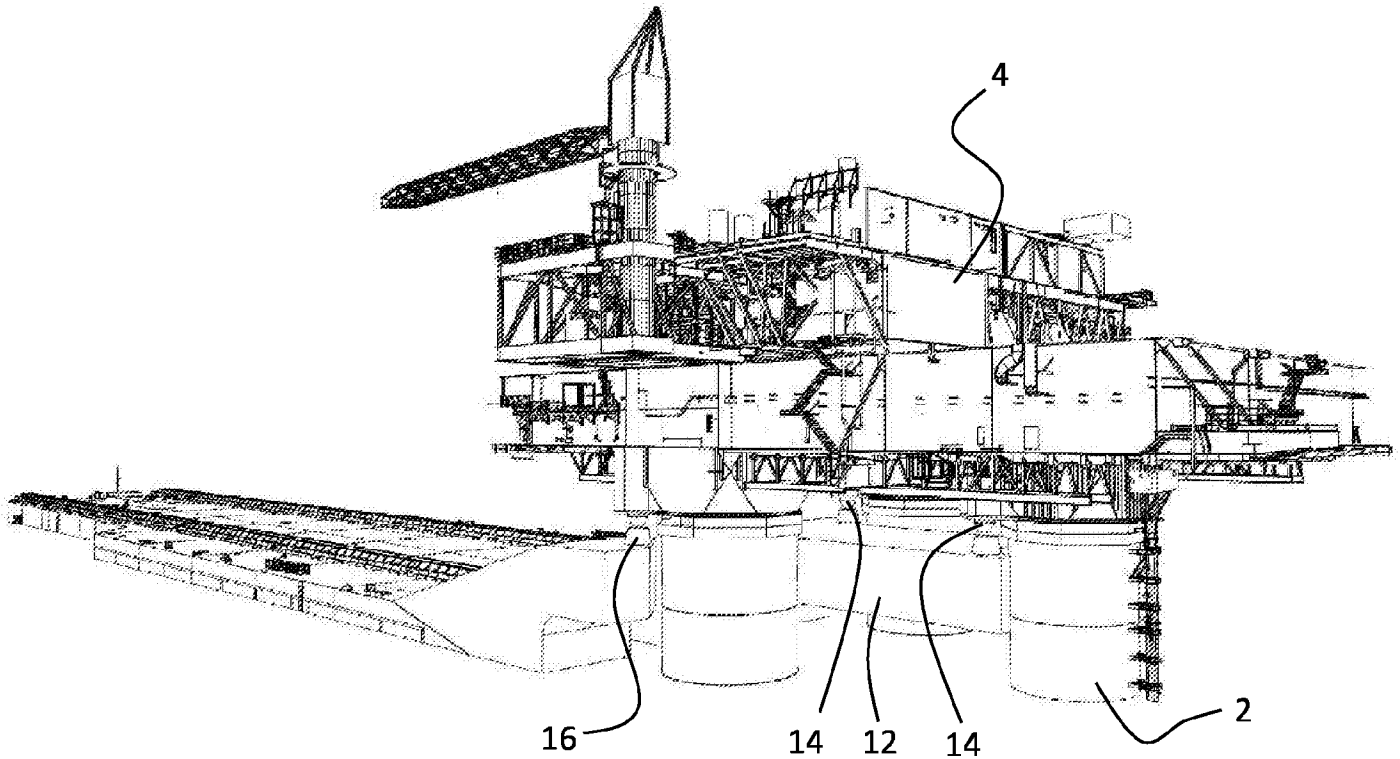

Turning to FIG. 2A, a reversed float over method according to the prior art is shown. The support structure 2 is formed by large columns. A barge 10 having projecting support arms 12 are positioned close to the offshore platform. As shown in FIG. 2B, the projecting support arm is positioned underneath the topside 4. Prior to this step, male connectors 14 have been welded to the underside of the topside. It is noted that the male/female form can be inverted.

The support arms 12 have supports 16 which mate with the downwardly protruding male connectors 14.

Figure 2C:
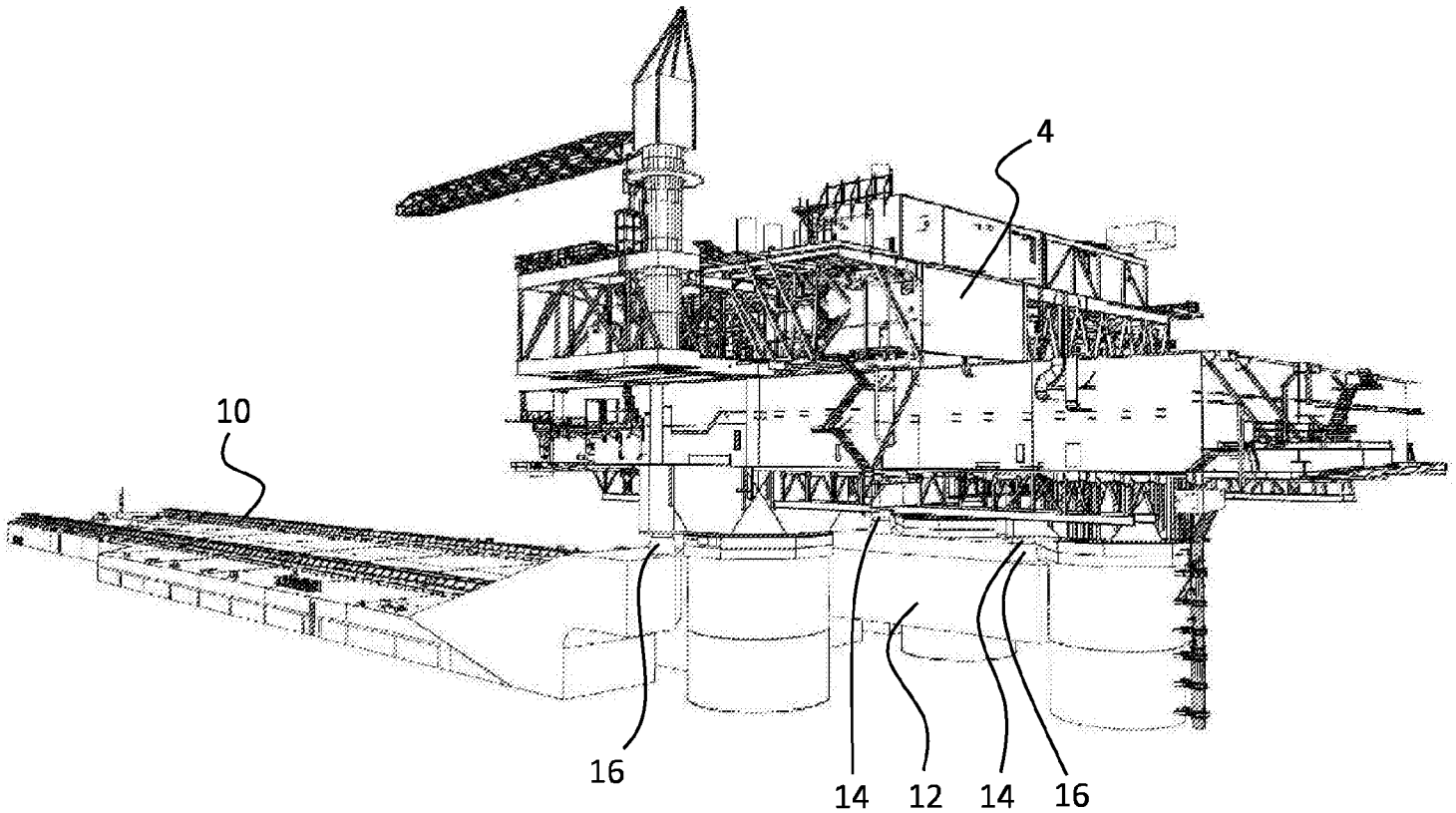

Turning to FIG. 2C, the supports 16 engage with the male connectors 14 and the lifting operation begins. During the lifting operation, ballast tanks in the barge 10 are deballasted and the weight of the topside 4 is gradually transferred from the support structure to the lifting barge. This process may take several hours. During this time, horizontal loads on the barge as a result of wind, waves and current are transferred into the support structure. This is disadvantageous because the support structure 2 is generally not designed to take such loads. Failure of the support structure may result.

Figure 2D:
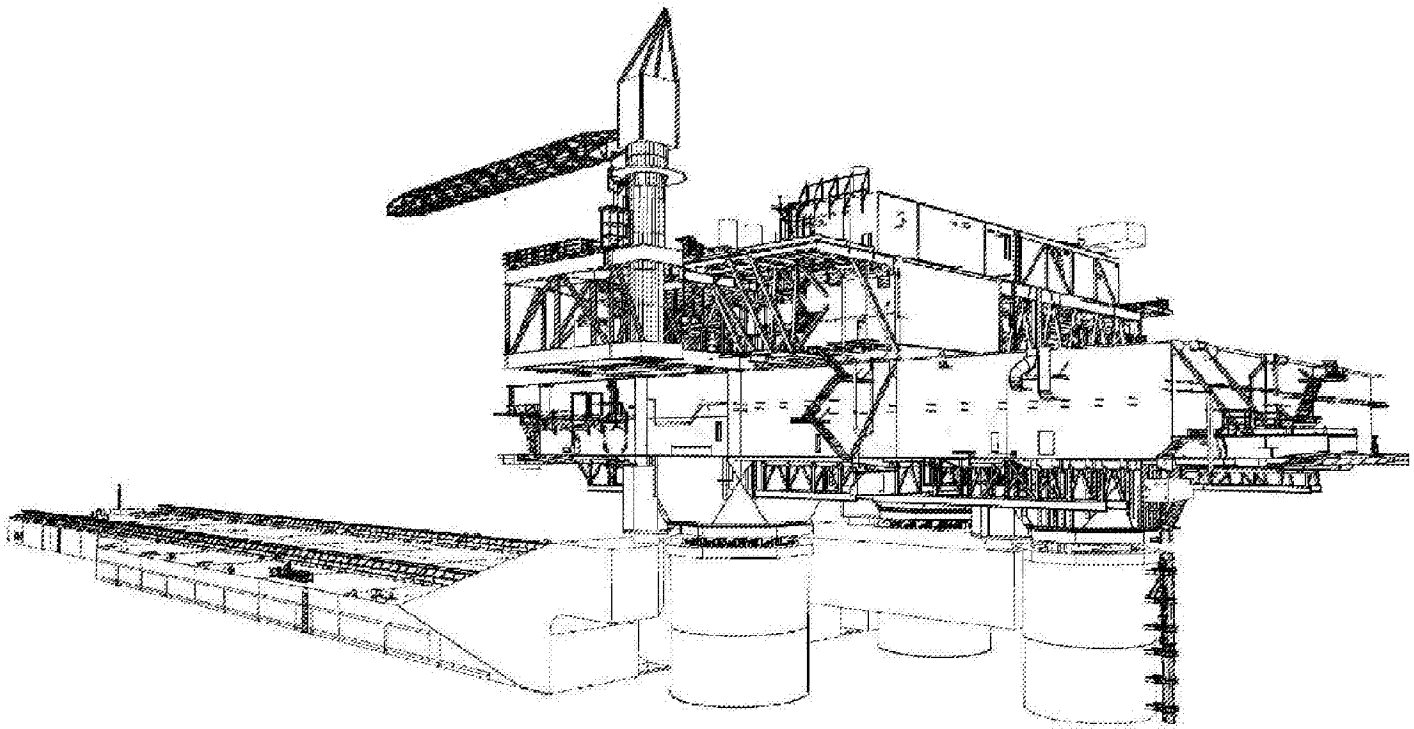
Figure 2E:
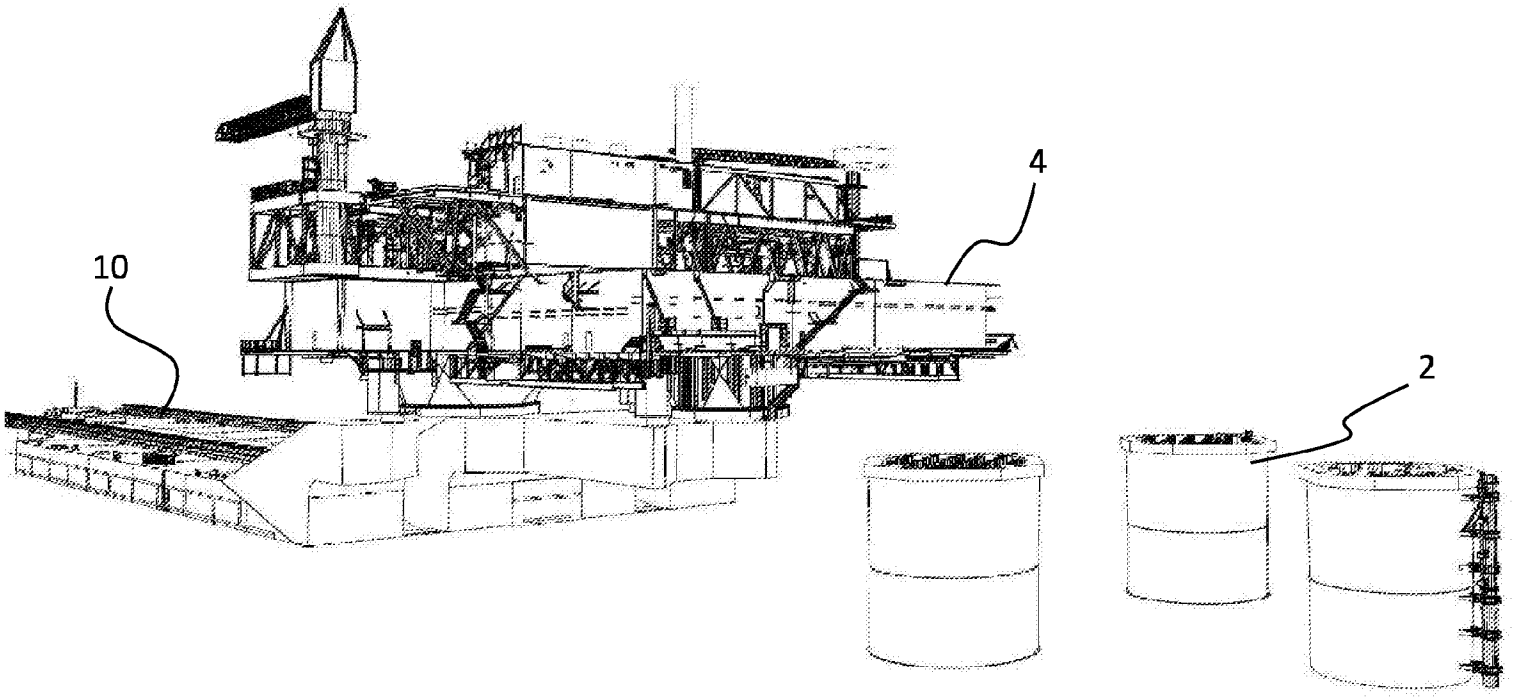
Figure 2F:
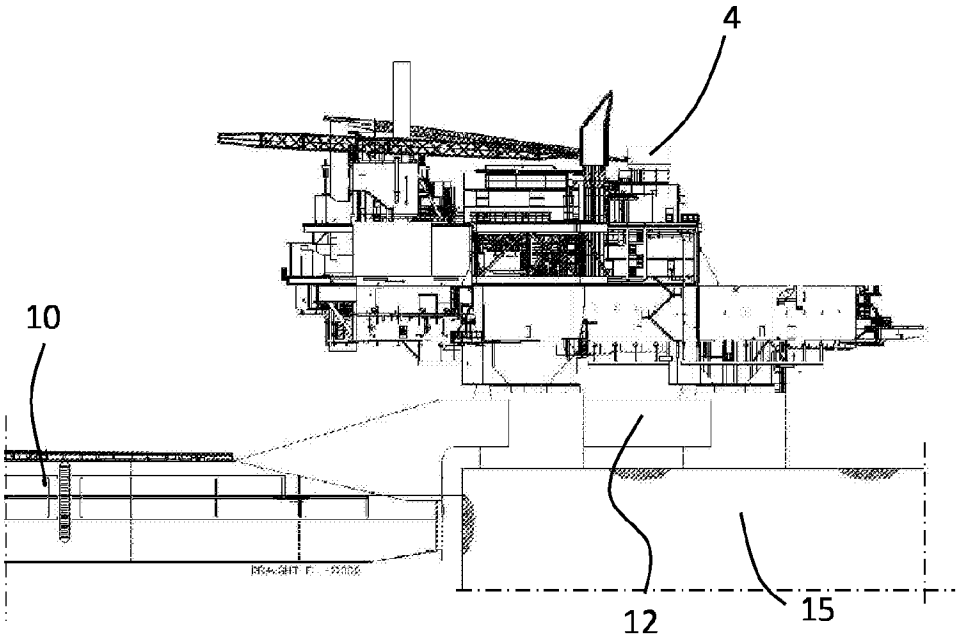
Figure 3:
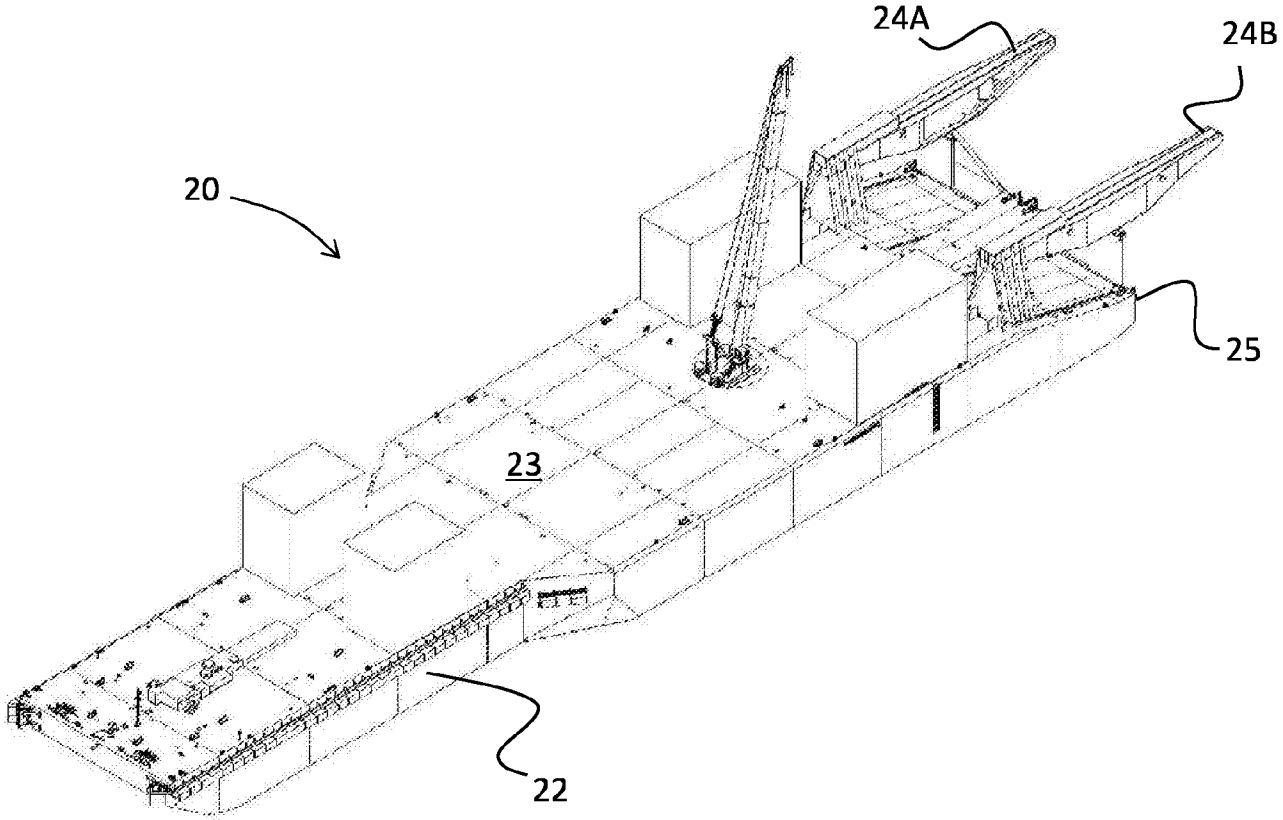
FIG. 3 shows a birdseye view of a lifting vessel according to the invention.
Figure 4:
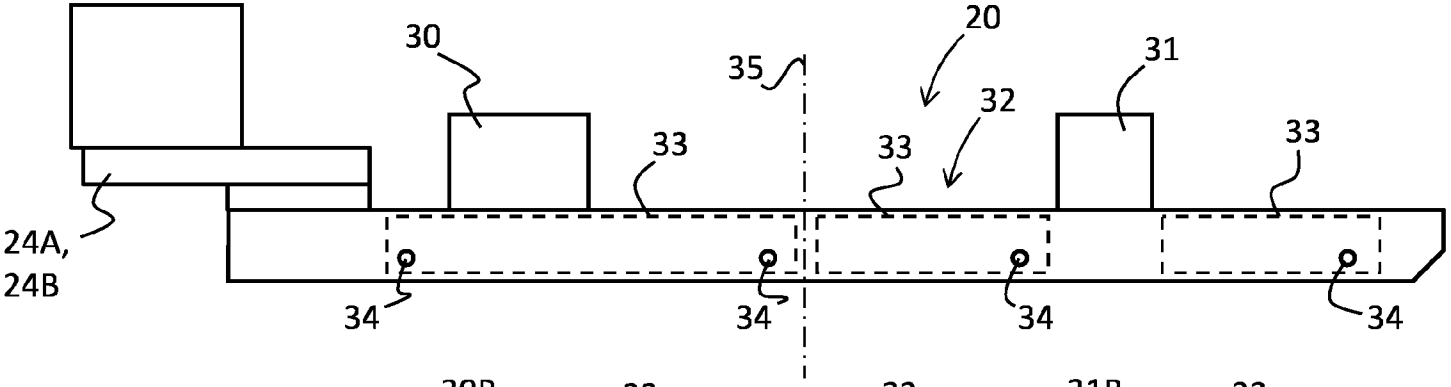
FIG. 4 shows a side view of a lifting vessel according to the invention.
Figure 5:
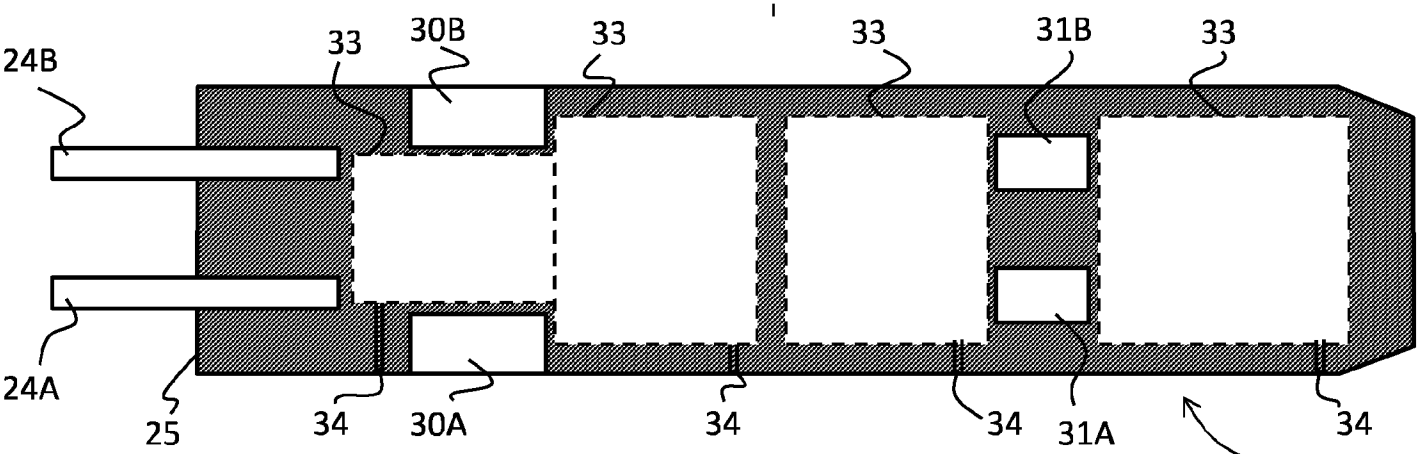
FIG. 5 shows a side view of a lifting vessel according to the invention.

Turning to FIG. 2D, the lift-off takes place once the lifting capability of the barge is large enough. Turning to FIG. 2E, the topside is towed to shore for dismantling. Turning to FIG. 2F, the topside may be transferred from the support arms to the quay side 15 in a skidding movement. The topside can then be dismantled on the quay side.

Turning to FIGS. 3, 4, 5, 6 and 7 the vessel 20 according to the invention is shown. The vessel comprises a hull 22 which in elongate. The hull has a deck 23. Two lifting arms 24A, 24B are provided near the stern 25 of the vessel and project in a rearward direction. The arms may alternatively be provided at the bow and project forward. The lifting arms cantilever over the water surface. Multiple support devices according to the invention are provided on these lifting arms as will be discussed below.

The lifting arms are supported by arm supports 26 at a horizontal level 27 which lies at a distance 28 above a deck of the lifting vessel and at a distance above the water level. The arm support are steel structures which are mounted to the deck 23. The lifting arms project in a general longitudinal direction away from the hull.

Inside the hull, multiple ballast tanks 33 are located. These ballast tanks may be located at least partially beneath the water line. On top of the deck and above the water line additional ballast tanks 30, 31 are provided. The ballast tanks inside the hull are called lower ballast tanks 33. The ballast tanks on deck are called upper ballast tanks.

The upper ballast tanks comprise discharge valves and are constructed to be quickly emptied under the influence of gravity for quickly increasing a lifting capability of the lifting vessel. The lower ballast tanks are wholly or partially positioned below the water line, in particular within the hull of the lifting vessel. These tanks are emptied with a pumping system 34 with which the lower ballast tanks can be emptied relatively slowly.

The upper ballast tanks comprise at least two groups of upper ballast tanks: a first group 30 positioned near the lifting arms, and a second group 31 positioned on a front half 32 of the lifting vessel. The dashed vertical line 35 in FIG. 4 indicates the midplane of the vessel. The second group of tanks is positioned to the front of said mid plane. The first group 30 is positioned to the rear of the midplane. The first and second group of upper ballast tanks both include a right tank 30A, 31A (starboard side) and a left tank 30B, 31B (port side) so that a roll angle of the vessel can be corrected and the vessel can be held horizontal. The same applies for the lower ballast tanks. The tanks can be filled and emptied independently from one another.

Constructive Aspects of the Support Device and Mating Connecting Device

Figure 6:
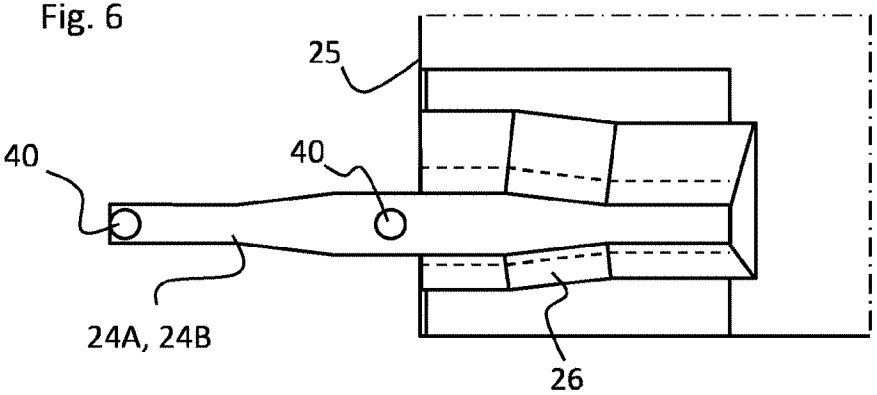
FIG. 6 shows a top view of a lifting arm of a lifting vessel according to the invention.
Figure 7:
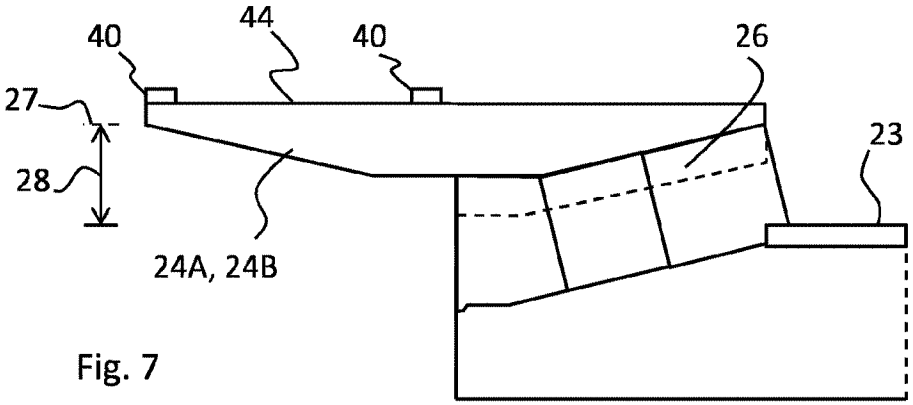
FIG. 7 shows a side view of a lifting arm of a lifting vessel according to the invention.
Figure 8:
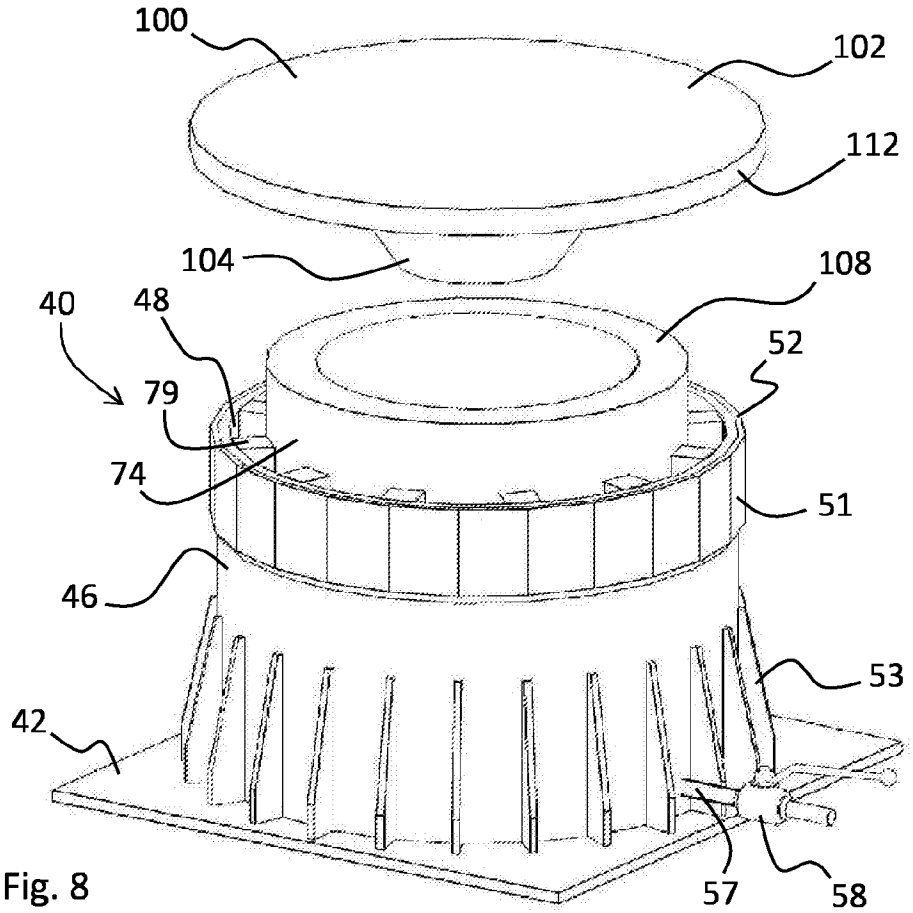
FIG. 8 shows an isometric view of a support device according to the invention.
Figure 9:
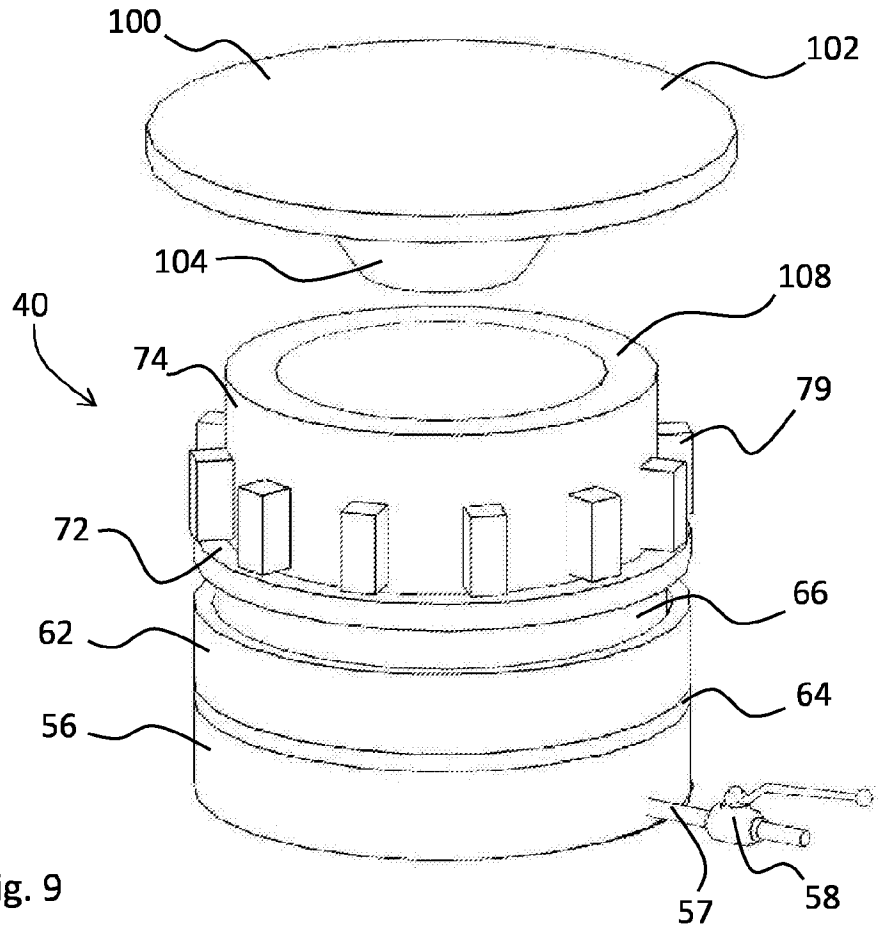
FIG. 9 shows an isometric view of a support device according to the invention with the main casing left out.

Turning to FIGS. 6 and 7, the lifting vessel comprises multiple support devices 40 which are constructed to be positioned on the arms of the lifting vessel in order to support a topside which is to be lifted and transported by the lifting vessel.

Turning to FIGS. 8, 9, 10, 11 and 12, the support device 40 comprises a base plate 42. The base plate is designed to be welded to the upper surface 44 of a lifting arm 24A, 24B as shown in FIGS. 4-7. The upper surface 44 is indicated in FIG. 7. The base plate 42 will generally be made of steel, as will most of the other parts of the lifting device.

On the base plate, a main cylindrical casing 46 is positioned. The main casing has a round shape when seen in top view, although other shapes are conceivable. The main casing has an upper opening 48. The main casing defines a main vertical axis 50 which is an axis of rotational symmetry.

The main casing further defines an annular upper support rim 52 which will be discussed further below. The main casing may have a thickened portion 51 at the upper end which defines this support rim. Reinforcement members 53 in the form of steel plates may be provided at the base of the main casing for further reinforcement.

A reservoir 55 is located inside the main casing for holding sand 56 or a similar granular material. A reservoir for a liquid may also be conceivable. A reservoir for holding a gas may also be possible. The reservoir may be located at the bottom of the main casing. The base plate 42 forms the lower wall of the reservoir. The reservoir has a discharge opening 57 with a valve 58 for emptying the reservoir. The emptying may take place by flushing out the sand with water.

The support device further comprises a spring support 60 slideably arranged within the main casing. The spring support 60 rests on the particles and is movable from an upper position shown in FIG. 10 to a lower position shown in FIG. 12 in dependence on a filling degree of the reservoir. The spring support has an upstanding cylindrical wall 62 which extends upward from a spring support base plate 64.

The support device further comprise a spring device 66 positioned on the spring support 60. The spring device 66 is compressible in a vertical direction between an extended state shown in FIG. 10 and a compressed state shown in FIGS. 11 and 12.

The spring support 60 comprises an upward facing contact surface 65 which is the upper surface of the upstanding cylindrical wall 62. The two opposing contact surfaces 65, 71 are configured to engage with one another at a predetermined compression of the spring device 66, wherein the spring device is configured to make a compression stroke between an uncompressed state shown in FIG. 10 and a compressed state shown in FIGS. 11, 12 in which the contact surfaces engage one another.

After the contact surfaces 65, 71 make contact, any subsequent increase in the lifting force is transferred from the receptor support 70 onto the particles 56 via the engaging contact surfaces and the wall 62 and not via the spring device. The engaging contact surfaces 65, 71 prevent further compression of the spring device, and maximize the force on the spring device.

The support device 40 further comprises a receptor support 70 positioned on the spring device, the receptor support defining an upper surface 72. The receptor support 70 comprises an associated downward facing contact surface 71.

The support device 40 further comprises a female receptor device 74 positioned on the upper surface 72 of the receptor support 70 and being slideably arranged on said receptor support. The receptor device 74 has a lower surface 76 which rests on the upper surface 72. At least one (or both) of these surfaces 72, 76 is slippery, allowing a sliding movement of the female receptor device 74 relative to the receptor support 70. To this end, at least one of the surfaces 72, 76 may be provided with a layer of Teflon (PTFE). The Teflon allows sliding even when the loads are very high. Teflon also has an advantage that the friction coefficient reduces when the vertical load increases.

In an alternative embodiment, the female receptor device 74 and the receptor support 70 are integrated, and the surfaces 65, 71 are configured to slide relative to one another in order to allow the horizontal movement, wherein at least one of these surfaces is slippery.

The female receptor device has a depression 78 configured for receiving a male connector 104 of a male connecting device 100 which is connected to a topside which is to be lifted. The depression has a bottom which faces upwards. The depression has a cone shape and is also referred to as a receptor cone 78. A horizontal clearance 75 is defined around the female receptor device, between the female receptor device and the main casing 46, in particular the thickened upper portion 51 of the main casing, wherein the sliding action between the surface 72, 76 and the horizontal clearance create a horizontal freedom of movement of the female receptor device relative to the main casing as shown by arrow 77. The freedom of movement exists in two independent horizontal directions X and Y.

The clearance 75 between the female receptor device 74 and the main casing is annular and a spring device comprising multiple resilient members 79 is provided in the clearance for creating a counterforce when horizontal displacements of the female receptor device relative to the main casing occur. The resilient elements may be rubber elements. A width 77 of the clearance may in particular be at least 100 mm. The resilient members prevent impact of the female receptor device against the main casing.

A vertical spring stiffness of the spring device 66 lies between 10.000 and 30.000 N/mm and a horizontal spring stiffness of the resilient members 79 lies between 10.000 and 40.000 N/mm.

A total height 80 of the support device may be less than 4 meter, in particular less than 3 meter, more in particular about 2 meter. The reduced height provides advantages when the lifting arms need to be positioned within the support structure. Less beams (or bracings) of the support structure need to be removed to provide room, and the lifting arms themselves can be made higher and therefore stronger.

The main casing, the reservoir, the spring support, the spring device, the receptor support and the female receptor device have a circular form when seen in top view and are coaxially arranged.

The male connecting device 100 is constructed to mate with the support device 40 according to the invention. The male connecting device comprises an upper base plate 102, and a male connector 104 (also referred to as a male connector 104), in particular having a truncated cone shape, which projects downwardly from the upper base plate.

The male connecting device 100 comprises at least one receptor contact surface 106 which faces downward and is provided circumferentially around the male connector. The at least one receptor contact surface 106 is configured for engaging an upward facing contact surface 108 of the female receptor device 74.

The male connecting device 100 further comprises at least one second contact surface 110 which faces downward and is provided circumferentially around the at least one first contact surface 106, wherein the at least one second contact surface 110 is configured for engaging the upper support rim 52 of the main casing.

The male connecting device further comprises at least one welding area constructed to be welded to an associated welding area on the main casing 46 of the support device. The welding area of the male connecting device can be the outer ridge of the base plate 102. The associated welding area of the support device can be the outer upper ridge of the main casing, in particular the thickened portion thereof. This allows sea fastening of the topside to the lifting vessel.

The invention further relates to a combination of a support device and a male connecting device.

Method of Operation of the Support Device and Male Connecting Device

The support device works as follows. Five stages can be distinguished in the lifting operation:

1) Positioning and preparation stage,
2) Engagement stage,
3) Load transfer stage,
4) Lift-off stage
5) Transport stage During the positioning and preparation stage, the lifting vessel is first towed within range of the offshore platform and waits for a suitable weather window. The male connecting devices are fixed to the topside or to the upper part of the support structure.

In this document, when the term "topside" is used, the topside may also comprise a small upper section of the support structure, because sometimes it is more practical to include a small upper section of the support structure in the lifting operation. For ease of reference the word "topside" is intended to cover that situation.

Figure 13:
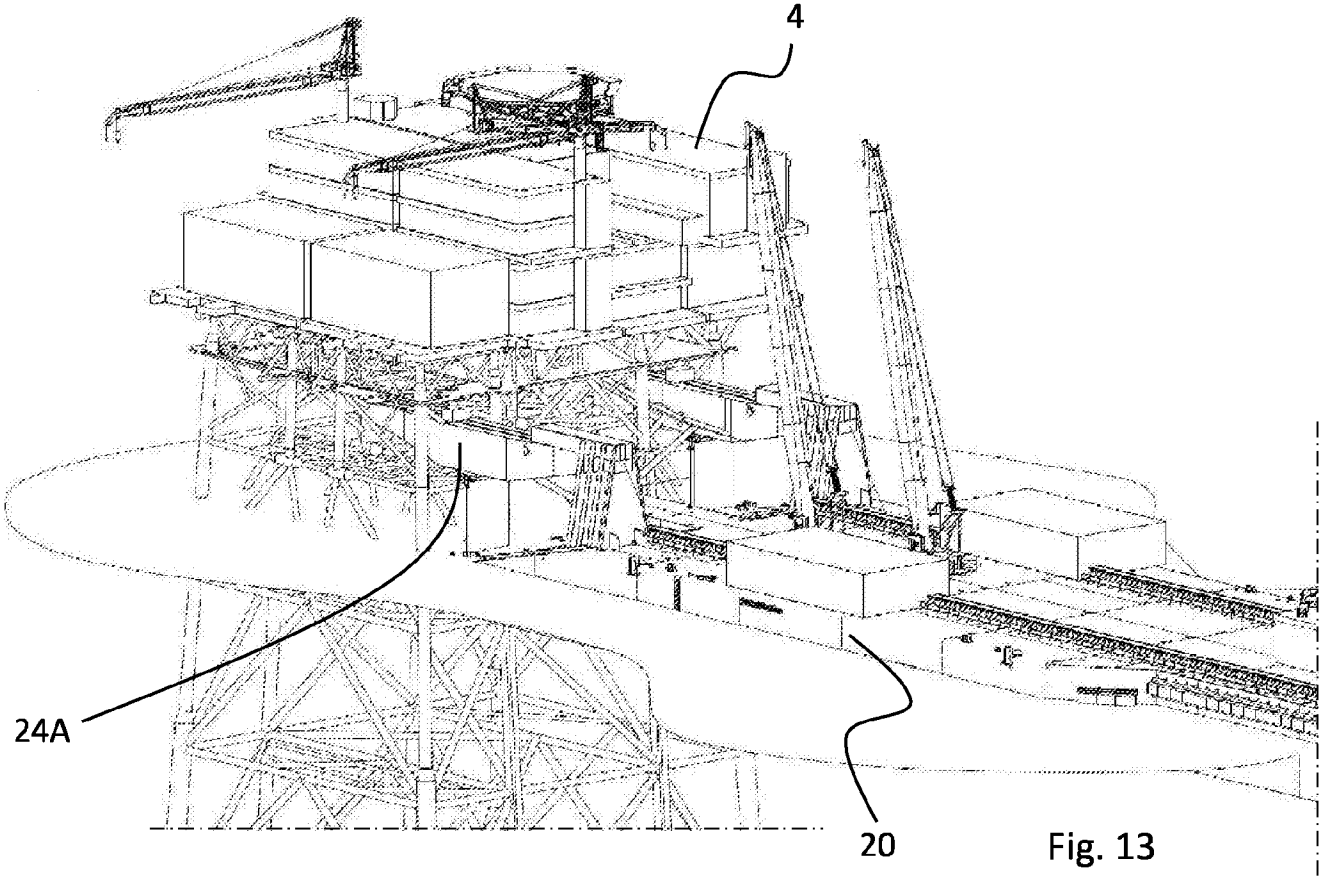
FIG. 13 shows step in the lifting operation.

A part of the support structure may be removed to provide room for the lifting arms of the lifting vessel. Reinforcements may be provided at the topside. When the weather forecast is suitable, lifting vessel is positioned relative to the offshore platform by tug boats mooring lines or a combination thereof. The lifting arms penetrate through open spaces in the support structure and are positioned underneath the topside. This situation is shown in FIG. 13.

Figure 10:
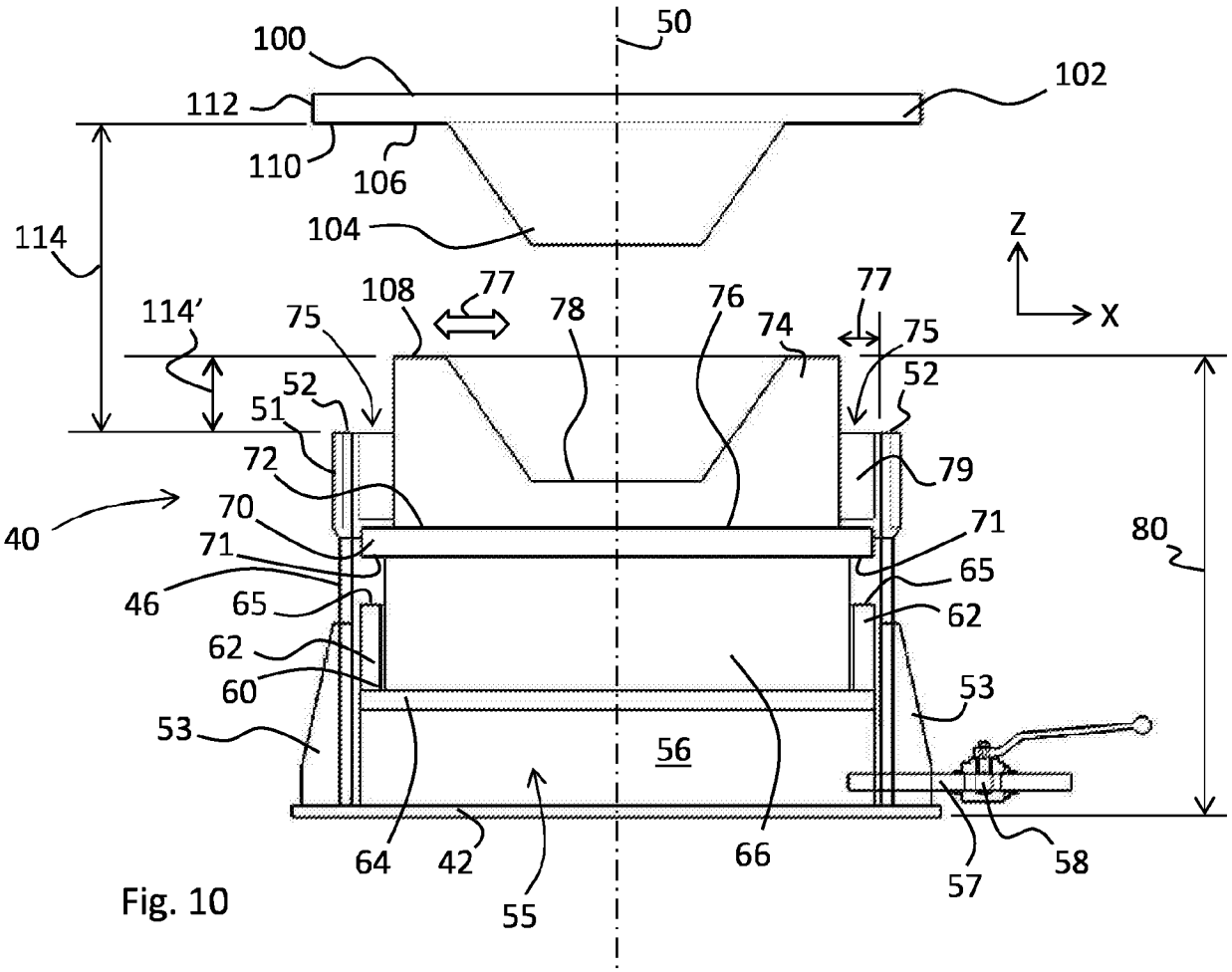
FIG. 10 shows a sectional side view of a support device according to the invention in a first state.

Turning to FIG. 10, the support device 40 and male connecting device 100 are shown at the start of the engagement stage, just prior to engagement. The male connecting device is fixed to the topside which is to be lifted. The support device 40 is mounted on one of the lifting arms 24A, 24B. A vertical gap 114 exists between the two.

After the lifting vessel is positioned underneath the topside, the upper ballast tanks 30, 31 are emptied in a first lifting step. The ballasting takes place by gravity via discharge openings in a rather short period of time and as a result, the lifting vessel raises. In this relatively short period of time, i.e. between 30 seconds and five minutes, the vertical gap 114 between the support device 40 and the male connector 100 is reduced. The engagement takes place between the at least one receptor contact surface 106 and the upward facing contact surface 108 of the female receptor device 74. During the subsequently vertical movement, the receptor cone guides the male connector into place. The receptor cone may move horizontally to assist this guiding process.

When the male connecting device has engaged the support device but prior to any compression of the support device, a vertical gap 114' is present between the upper support rim 52 of the support device and the at least one second contact surface 110 of the male connecting device, wherein said vertical gap is between 100 and 500 mm. The receptor device is in its upper position.

Figure 11:
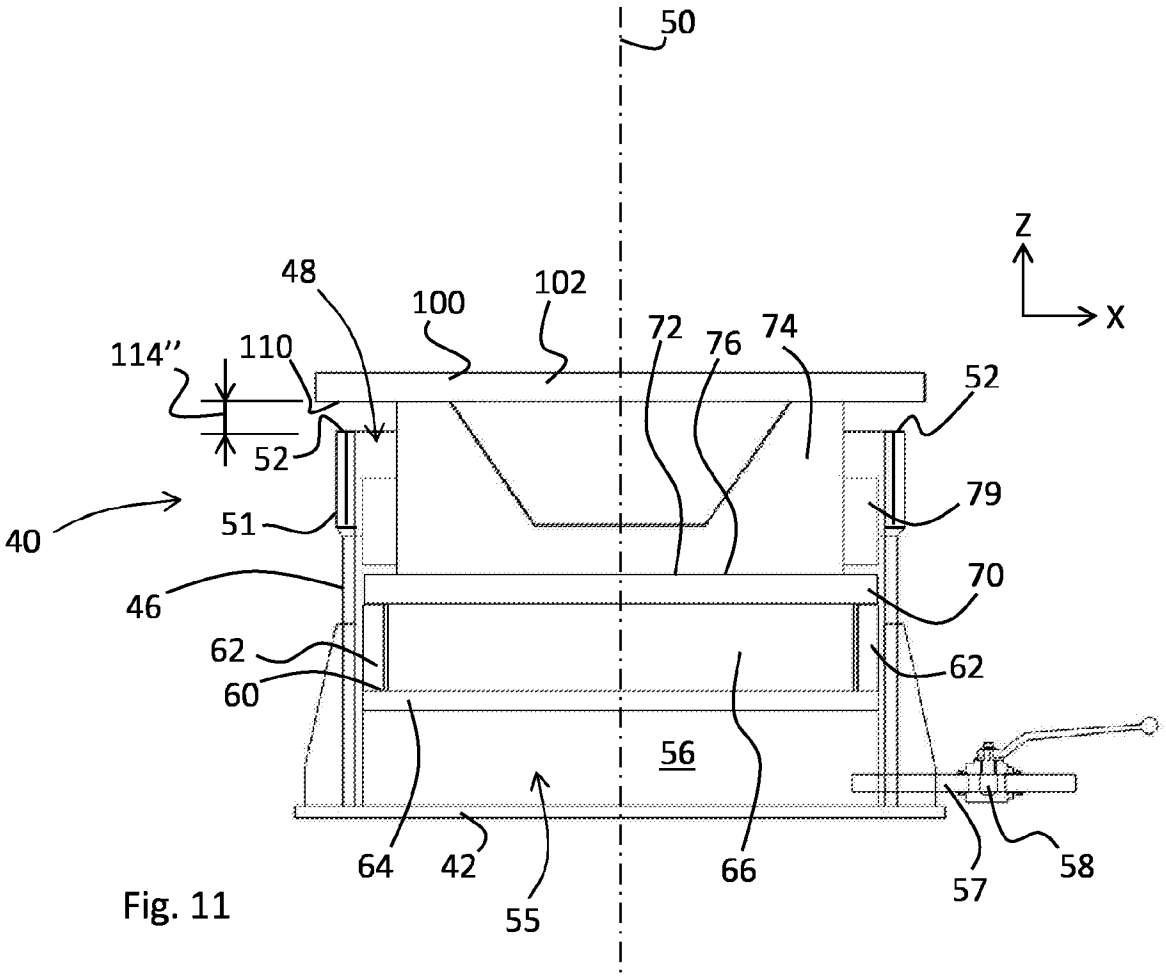
FIG. 11 shows a sectional side view of a support device according to the invention in a second state.
Figure 12:
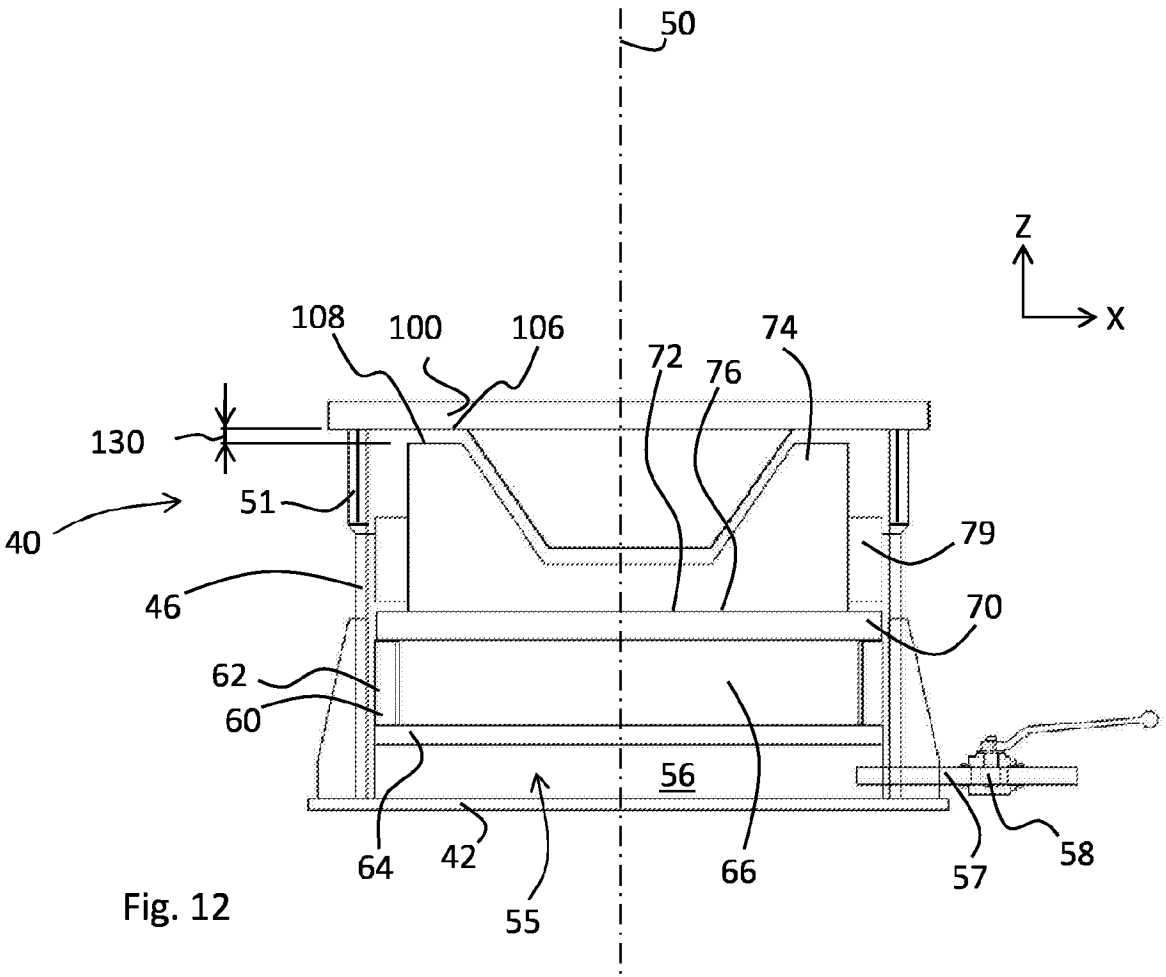
FIG. 12 shows a sectional side view of a support device according to the invention in a third state.

The emptying of the upper ballast tanks continues after this point at a high pace and the spring device is compressed to a point where the contact surfaces 65, 71 meet. This state is shown in FIG. 11. A vertical lifting force (i.e. a pre-tension force) exerted by the support devices on the male connector is increased relatively quickly to a predetermined level in order to prevent disengagement of the support devices from the associated male connectors, and to prevent impact between the lifting vessel and the topside in case of waves. The receptor device 74 is now in its intermediate position.

The pre-tension is basically a part of the total weight of the topside which is now carried by the lifting vessel via the support devices 40. The total pre-tension may be in the order of 2000 mT, depending on the size of the topside. If there are four support devices, each support device will carry 500 mT. The pre-tension results in a compression of the spring device. The spring device becomes maximally compressed and the contact surfaces 65, 71 engage with one another. During the first lifting step the vertical gap 114' between the at least one second contact surface 110 and the upper support rim 52 of the main casing 46 is reduced from 114' (see FIG. 10) to 114" (see FIG. 11) but is not entirely closed. Any further increase in the vertical force bypasses the spring device and is transferred via the contact surfaces 65, 71. This is the end of the engagement stage.

As an alternative to performing the first lifting step with deballasting, it is conceivable to increase the height of the support devices relatively quickly by elevating the support devices relative to the lifting vessel, for instance by jack-up units positioned underneath the support device.

The load-transfer stage now begins. The lower ballast tanks are gradually emptied by pumping in a second lifting step. During this time the upper ballast tanks are re-filled, but at a slower rate than the de-ballasting of the lower ballast tanks. This stage is called the load transfer stage. In the load transfer stage, the lifting vessel gradually takes on about 80-90 percent of the weight of the topside. This stage typically takes a number of hours, for instance 4-8 hours. During the load transfer stage, a limited freedom of movement exists in two horizontal directions X,Y between the support device 40 and the male connector 100. The movement takes place by letting the female receptor device 74 slide over the receptor support 70.

The resilient members 79 act as fenders for this horizontal movement. The horizontal freedom of movement reduces the horizontal loads on the support structure as a result of movements of the lifting vessel. During the load transfer stage, the support device is not substantially compressed, at least when compared to the engagement stage.

Next, the lift-off stage takes place. The upper ballast tanks are emptied once again in a relatively short period of time (typically between 30 seconds and five minutes) in a third lifting step. The remainder of the weight of the topside is transferred to the lifting vessel and the topside is lifted from the support structure. A vertical clearance between the topside and the support structure is created in a relatively short period of time in order to prevent impact between the two separated parts as a result of waves. The vertical clearance may be 1 meter or more.

After the lift-of stage has been completed, the lifting vessel is moved away from the support structure. The combination of lifting vessel and the topside now has to be prepared for transport, which can take place over a considerable distance and with less than ideal weather conditions. The freedom of movement between the lifting vessel and the topside which was advantageous during the load transfer stage, becomes disadvantageous for transport and is now removed.

To this end, the reservoir 55 is emptied by discharging the sand, if required by flushing with water. If the reservoir contains a liquid, the liquid is discharged. The at least one second contact surface 110 of the male connecting device 100 comes to rest on the upper support rim 52 of the main casing and is subsequently welded to said upper rim. Another kind of connection than welding is also possible. The receptor device 74 is now in its lower position and is disengaged from the mating connector. In this way the horizontal freedom of movement is removed and the support device and male connecting device are fixed relative to one another. In this state, the topside is ready for transport.

The various stages in the operation require different behaviour from the support device. The support device is designed to meet these requirements passively.

Figure 14:
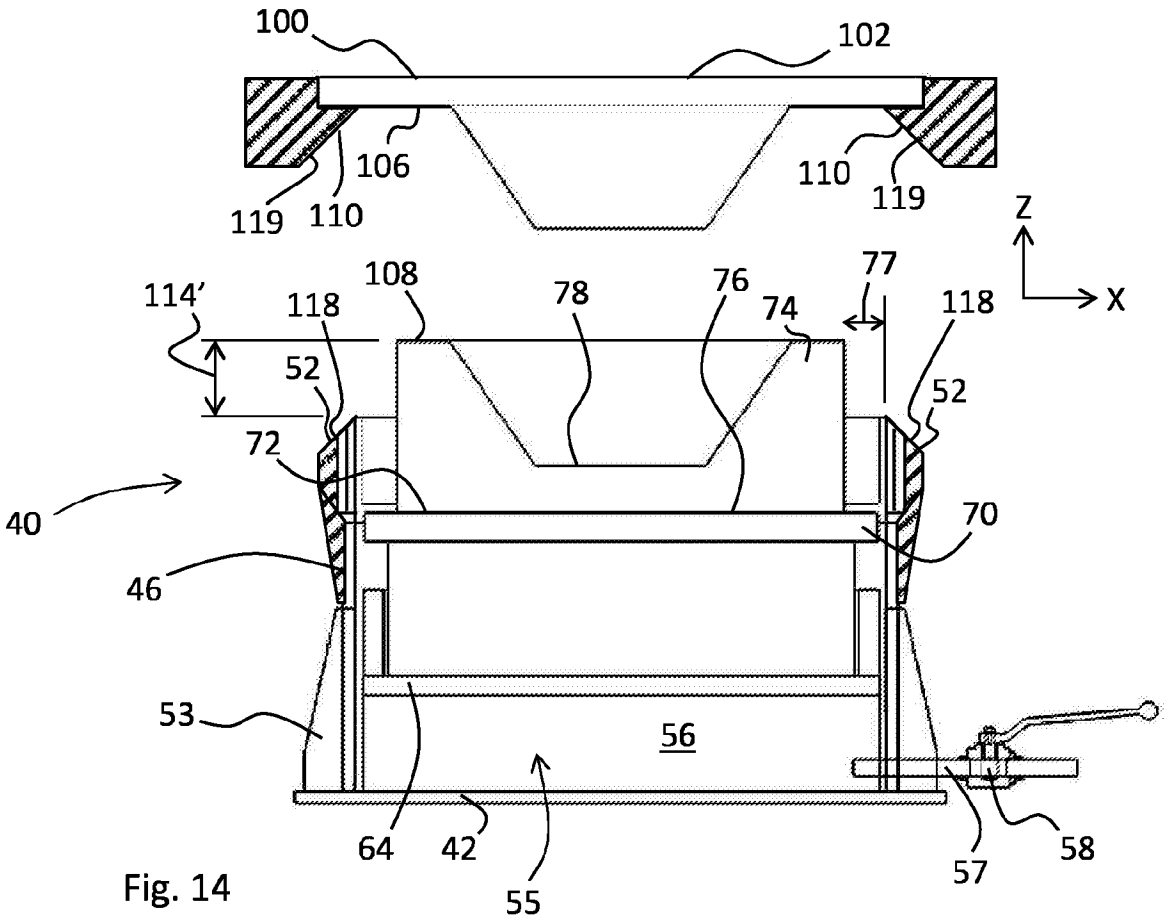
FIG. 14 shows a sectional side view of another embodiment of the invention

Turning to FIG. 14, a further embodiment is shown which is similar to the embodiment of FIG. 10, with an extra feature that the upper support rim 52 of the main casing and the second contact surface 110 which mates with the upper support rim 52 comprise tapered parts 118, 119 which have the function of guiding the connecting device 100 onto the support rim. The tapered parts provide horizontal fixation. With this embodiment, it may be possible to do without the welding operation.

The thickened portion 51 of the main casing has a greater thickness and a greater height than in the embodiment of FIG. 10.

The present invention is in particular suitable for offshore platforms having relatively "weak" legs of the support structure.

In an embodiment, the support device 40 is relatively small, which allows it to be used in a relatively wide range of occurring situations.

The present invention can be used in a forklift method, i.e. with a lifting vessel having protruding arms, but also in a float over method, wherein the hull of the vessel is positioned under the topside.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising i.e., open language, not excluding other elements or steps.

Any reference signs in the claims should not be construed as limiting the scope of the claims or the invention. It will be recognized that a specific embodiment as claimed may not achieve all of the stated objects.

The mere fact that certain measures are recited in mutually different dependent claims does not indicate that a combination of these measures cannot be used to advantage.

The invention claimed is:

1. A support device configured to be positioned on a lifting vessel in order to support a topside of an offshore platform which is to be lifted and transported by the lifting vessel, the support device comprising:

a main cylindrical casing having an upper opening, the main casing defining a main vertical axis, the main casing further defining an upper support rim, a reservoir located inside the main casing for holding a granular material or a fluid, the reservoir having a discharge opening for emptying the reservoir, a spring support slideably arranged within the main casing, the spring support resting on the granular material or the fluid and being movable from an upper position to a lower position in dependence on a filling degree of the reservoir, a spring device positioned on the spring support, the spring device being compressible in a vertical direction between an extended state and a compressed state, a receptor support positioned on the spring device, the receptor support defining an upper surface, and a receptor device having a lower surface which engages the upper surface of the receptor support, wherein the lower surface and upper surface are constructed to slide relative to one another, wherein a horizontal clearance is defined around the receptor device between the receptor device and the main casing, wherein the receptor support and the horizontal clearance create a horizontal freedom of movement of the receptor device relative to the main casing, wherein the receptor device is configured for receiving a mating connector of a connecting device which is connected to a topside which is to be lifted.

2. The support device according to claim 1, wherein the support device is configured to make a transition from:

an engagement state in which the spring device is uncompressed and the reservoir is filled, into a load transfer state in which the spring device is in the compressed state and in which a steel on steel support is provided parallel to the spring device, wherein the steel on steel support bears any increase in a vertical force exerted by the connecting device on the support device, and in which the reservoir is filled, and wherein a horizontal freedom of movement exists between the receptor device which accommodates the mating connecting device and the main casing, and from the load transfer state into a transport state in which the reservoir is emptied and the male connecting device directly rests on the main casing of the support device and is connected thereto via a fixed connection.

3. The support device according to claim 1, wherein the spring support comprises an upward facing contact surface, and wherein the receptor support comprises an associated downward facing contact surface, wherein said contact surfaces are configured to engage one another at a predetermined compression of the spring device, wherein the spring device is configured to make a compression stroke between an uncompressed state and a compressed state in which the contact surfaces engage one another, and wherein any subsequent increase in the lifting force is transferred from the receptor support onto the particles in the reservoir via the engaging contact surfaces and not via the spring device, wherein the engaging contact surfaces prevent any further compression of the spring device.

4. The support device according to claim 1, wherein the receptor device has an upper position in the engagement state, an intermediate position in the load-transfer state and a lower position in the transport state.

5. The support device according to claim 1, wherein the receptor device is a female receptor device and wherein the mating connector is a male connector.

6. The support device according to claim 1, wherein the receptor device has a freedom of movement in two independent horizontal directions (X, Y) relative to the main casing.

7. The support device according to claim 1, wherein the horizontal clearance between the receptor device and the main casing is annular and wherein resilient members are provided in the clearance for creating a counterforce when horizontal displacements of the receptor device relative to the main casing occur, and wherein a width of the clearance is in particular at least 100 mm.

8. The support device according to claim 1, wherein a vertical spring stiffness of the spring device lies between 10.000 and 30.000 N/mm and wherein a horizontal spring stiffness of the resilient members lies between 10.000 and 40.000 N/mm, and wherein the spring device comprises resilient elements, in particular rubber elements.

9. A lifting vessel comprising multiple support devices according to claim 1.

10. The lifting vessel according to claim 9, comprising a hull and two lifting arms which project from the hull and are suspended over the water surface, wherein the multiple support devices are positioned on the lifting arms.

11. The lifting vessel according to claim 9, wherein the support devices are positioned on deck, and wherein the vessel is configured for carrying out a float-over operation, in which a hull of the vessel is positioned underneath the topside.

12. The lifting vessel according to claim 9, comprising:

upper ballast tanks positioned above the water line, in particular on deck, wherein the upper ballast tanks comprise discharge valves and are constructed to be quickly emptied under the force of gravity for quickly increasing a lifting capability of the lifting vessel, lower ballast tanks within the hull of the lifting vessel and positioned at least partially below the water line, and a pumping system with which the lower ballast tanks can be emptied relatively slowly.

13. The lifting vessel according to claim 9, wherein the lifting vessel is elongate and comprises two lifting arms at a stern or bow of the vessel, the lifting arms projecting in a general longitudinal direction away from the hull, wherein the upper ballast tanks comprise at least two groups of upper ballast tanks:

a first group positioned near the lifting arms, and a second group positioned on a rear half of the lifting vessel.

14. A combination of a support device according to claim 1 and a male connecting device constructed to mate with the support device, the connecting male device comprising:

an upper base plate, a mating connector, configured to mate with the receptor device of the support device, at least one first contact surface which faces downward, the at least one first contact surface being configured for engaging an upper receptor contact surface of the support device, and at least one second contact surface which faces downward and is provided circumferentially around the at least one first contact surface, the at least one second contact surface being configured for engaging the upper support rim of the support device, and at least one connecting area, in particular a welding area, constructed to be connected to the main casing of the support device.

15. A method of lifting a topside of an offshore platform from its support structure with a lifting vessel, the method comprising:

providing the lifting vessel and providing one or more support devices according to claim 1 on the lifting vessel, connecting multiple connecting devices at suitable locations to the topside which is to be lifted, wherein the connecting devices are constructed to mate with the support devices, each connecting device comprising:

an upper base plate, a mating connector, configured to mate with the receptor device of the support device, at least one first contact surface which faces downward, the at least one first contact surface being configured for engaging an upper receptor contact surface of the support device, at least one second contact surface which faces downward and is provided circumferentially around the at least one first contact surface, the at least one second contact surface being configured for engaging the upper support rim of the support device, and at least one connecting area, in particular a welding area, constructed to be connected to the main casing of the support device, positioning the lifting vessel relative to the topside, wherein the respective support devices are positioned vertically underneath the associated mating connectors, engaging the support devices with the mating connectors in a first lifting step, wherein a vertical lifting force exerted by the support devices on the mating connectors is increased relatively quickly to a predetermined force, wherein the spring device is compressed in order to prevent disengagement of the support devices from the associated mating connectors, de-ballasting the lifting vessel in a second lifting step, wherein the weight of the topside is transferred to the lifting vessel, and wherein the relative horizontal freedom of movement is maintained between the topside and the lifting vessel during the weight transfer, and reducing the volume of the reservoir so that the upper base plate contacts the upper support rim thereby supporting the topside.

16. The method according to claim 15, comprising lifting the topside from its support structure by further de-ballasting the lifting vessel in a third lifting step, wherein the third lifting step takes place relatively quickly in order to create a clearance between the topside and the remaining support structure to prevent impact of the topside with the remaining support structure.

17. The method according to claim 15, wherein:

in the second lifting step the lower ballast tanks are emptied at a relatively slow rate, thereby gradually increasing the lifting force and transferring the weight of the topside to the lifting vessel, and in the third lifting step the upper ballast tanks are at least partially emptied in order to quickly lift the topside from the support structure and to create a predetermined clearance between the topside and the support structure.

18. The method according to claim 15, wherein during the first lifting step the spring device is compressed and the contact surfaces of the spring support and the receptor support engage one another, in particular resulting in a steel on steel support, wherein the vertical freedom of movement between the support device and the male connecting device is removed, and wherein during the first lifting step the vertical gap between the upper support rim and the at least one second contact surface is reduced but is not entirely closed.

19. The method according to claim 15, wherein after the third lifting step the reservoir is emptied via the discharge opening, thereby lowering the spring support, the spring device, the receptor support and the receptor device, wherein the vertical gap between the upper support rim and the at least one second contact surface is closed, and wherein the vertical load is no longer transferred via the receptor device and the mating connector, but via the second contact surface and the upper support rim, and wherein by the emptying of the reservoir the receptor device is lowered from a middle position to a lower position and a second vertical gap is created between the upper receptor surface of the receptor device and the at least one first contact surface of the male connecting device, and wherein after the emptying of the reservoir, the male connectors are welded to the main casing for taking away the horizontal freedom of movement of the connecting device and ensuring a fixed connection between the lifting vessel and the topside.

20. The method according to claim 15, wherein during the second lifting step the upper ballast tanks are refilled in order to be ready for the third lifting step.

* * * * *